United States Patent [19]

Gavinski

[11] 4,366,848

[45] Jan. 4, 1983

[54] LOG SPLITTER

[76] Inventor: Frank R. Gavinski, Newaygo, Mich.

[21] Appl. No.: 228,150

[22] Filed: Jan. 26, 1981

[51] Int. Cl.[3] ..... B27L 7/00

[52] U.S. Cl. ..... 144/193 A; 144/193 D

[58] Field of Search ..... 144/3 K, 193 R, 193 A, 144/193 D

[56] References Cited

U.S. PATENT DOCUMENTS

| | | | |
|---|---|---|---|
| 2,612,194 | 9/1952 | Ingraham et al. | 144/24 |
| 2,634,457 | 4/1953 | Moyer et al. | 17/23 |
| 2,839,105 | 6/1958 | Gantenbine | 144/194 |
| 3,280,864 | 10/1966 | Spanenberg | 144/193 |
| 3,319,675 | 5/1967 | Bles, Sr. | 144/193 A |
| 3,596,691 | 8/1971 | Broadfoot | 144/193 |
| 3,974,867 | 8/1976 | Butas, Jr. | 144/193 |
| 4,192,364 | 4/1980 | Findley | 144/193 |
| 4,239,070 | 12/1980 | Burns | 144/193 A |

*Primary Examiner*—W. D. Bray

*Attorney, Agent, or Firm*—Price, Heneveld, Huizenga & Cooper

[57] ABSTRACT

A compact, stronger, and less costly double acting log splitting device is disclosed comprising a frame, defining a longitudinally extending channel and a log receiving table thereatop. The frame comprises first and second members having a generally L-shaped cross section, the first and second members being secured together to define the channel therebetween and the table thereatop. A double acting drive cylinder is provided along with means for mounting the drive cylinder on the frame underneath the table. First and second abutments are disposed on opposing longitudinal ends of the channel and a double acting wedge is mounted for longitudinal reciprocal movement between the first and second abutments. A dog leg shaped ram is mounted for reciprocal movement in the channel and the ram interconnects the double acting wedge and the drive cylinder. The log splitting device of the present invention is adapted for use as a self-contained unit including its own source of hydraulic pressure or may be used in conjunction with an independent source of hydraulic pressure such as the power take-off of a farm or garden tractor.

10 Claims, 10 Drawing Figures

LOG SPLITTER

BACKGROUND OF THE INVENTION

This invention relates generally to improvements in the art of log splitting and more particularly, relates to an improved hydraulic log splitter.

The manual activity of log splitting is increasingly giving way to mechanical devices which have been devised for forcing a wedge into a log and separating it into two or more segments. Hydraulic actuation of these devices is frequently used because of its simplicity and tremendous mechanical advantage. Hydraulic pressure may be created by a small internal combustion engine or pump which is mounted directly upon the log splitter or the device may be connected to an external source of hydraulic pressure such as that available on the power take-offs of most farm and garden tractors.

In the past, hydraulic log splitters have generally been provided with a drive cylinder mounted colinearly with a ram which carries a wedge that is driven into the log by the action of the hydraulic cylinder. This arrangement insures that the length of the device will approach or exceed three times the stroke of the ram. This produces a log splitting device which is rather long and cumbersome and effectively increases the moment arms through which many of the forces generated by the log splitter act upon. Consequently, longer lengths and heavier gauges of material must be used to construct the device. Furthermore, such an arrangement makes it difficult if not impossible to employ a double acting wedge which is capable of splitting in either direction. With this type of prior art hydraulic log splitter, the wedge must be reciprocated to an initial position disposed on one end of the splitter before another log can be placed in the splitter. This effectively doubles the length of time required to split a single log.

Double acting hydraulic log splitters with drive cylinders mounted below the table upon which the log is received are found in the prior art. However, in each case, these prior art devices are either complex, high production devices and/or include cylinders and frames formed from nonstandard elements which still further increase their cost and complexity.

SUMMARY OF THE INVENTION

According to the invention these and other problems in the prior art are solved by provision of a double acting log splitting device comprising a frame which defines a longitudinally extending channel and a log receiving table disposed thereatop. The cost and complexity of the device is reduced by provision of first and second frame members having a generally L-shaped cross section, the first and second frame members being secured together to define the channel therebetween and the table thereatop. A double acting drive cylinder is provided and means for provided for mounting the drive cylinder on the frame beneath the table. First and second abutments are disposed on the frame at opposing ends of the longitudinally extending channel. A double acting wedge is mounted for longitudinal reciprocal movement between the abutments and a leg shaped ram interconnects the wedge and the drive cylinder. Mounting the drive cylinder beneath the table and interconnecting the drive cylinder and the wedge with the dog leg shaped ram shortens the length of the device by approximately one half or more. Shortening of the log splitter reduces the moment arms upon which the log splitting forces act, reducing the material cost of the splitter since shorter lengths of material may be used and lighter gauge materials may be used. Furthermore, the dog leg shaped ram provides for the use of a double acting wedge which is capable of splitting a log compressed between either one of the first and second abutments disposed on opposing ends of the longitudinally extending channels. Thus, the operator need not reciprocate the wedge to one end of the log splitter to initiate the splitting of the log. That is to say, a log may be placed upon the table and the wedge may be reciprocated in one direction to split the log. Then a second log may be placed on the table and the wedge may be reciprocated in the opposite direction to split the second log without the need of reciprocating the wedge back to an initial position. This effectively shortens the length of time required to split a log by approximately one half.

DESCRIPTION OF THE PREFERRED EMBODIMENTS

Figure 2:
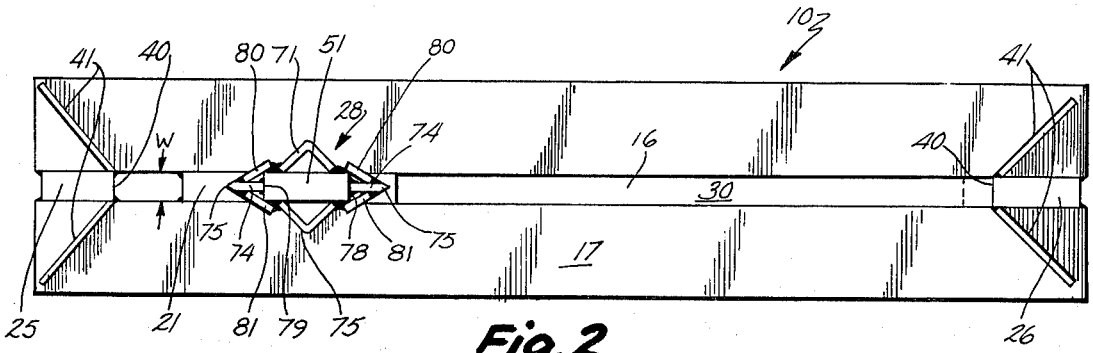
FIG. 2 is a plan view of the log splitting device of the present invention.
Figure 1:
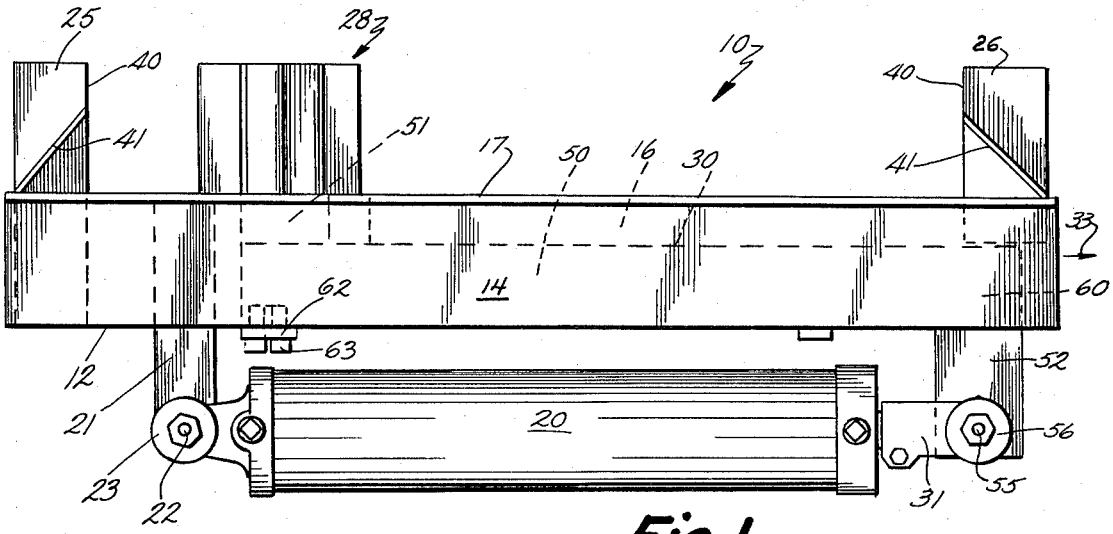
FIG. 1 is an elevational view of the log splitting device of the present invention.
Figure 3:
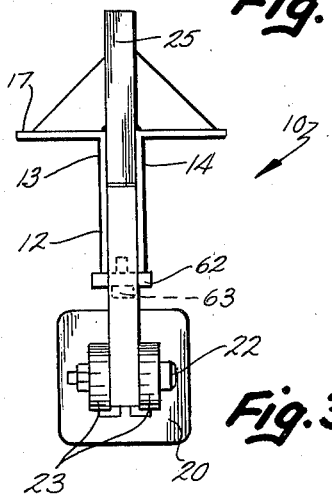
FIG. 3 is an end view of the log splitting device of the present invention.

Referring now to FIGS. 1, 2 and 3, the log splitting device of the present invention is illustrated at 10. The device comprises a frame which, as best illustrated in FIG. 3, is comprised of first and second members 13 and 14 having an L-shaped cross section. The first and second frame members 13 and 14 are secured together to define a longitudinally extending channel 16 disposed therebetween and a log receiving table 17 disposed thereatop. A double acting drive cylinder 20 is mounted on the frame 12 directly below the table 17. Means for mounting the drive cylinder 20 to the frame 12 comprises a post 21 secured between the first and second frame members 13 and 14 in any suitable manner, such as by welding. The post 21 includes an aperture, not illustrated herein, for receiving through bolt 22 which pins the yoke 23 of the drive cylinder 20 to the post 21. First and second abutments 25 and 26 are disposed on opposing longitudinal ends of the channel 16. A double acting wedge 28 is mounted for longitudinal reciprocal movement between the first and second abutments 25 and 26. A dog leg shaped ram 30 interconnects the wedge 28 and the connecting rod 31 of the drive cylinder 20. The ram 30 is mounted for reciprocal movement in the longitudinally extending channel 16 such that the double acting wedge 28 may be alternately driven into logs disposed between the wedge 28 and the first and second abutments 25 and 26. Provision of the dog leg shaped ram 30 allows placement of the drive cylinder 20 directly below the table 17. Including the fact that the body of the ram 30 will extend for a distance equal to the length of the stroke of the cylinder 20 in the direction of the arrow 33, the overall length of the device including the extended body of the ram 30 is approximately one third less than the overall length of prior art log splitting devices having drive cylinders mounted colinearly with the ram 30. This shortening of the log splitter substantially reduces the forces generated within the frame of the splitter during the splitting operation since the moment arms upon which the splitting forces act are substantially shortened. Thus, the material cost of the log splitter of the present invention is substantially lower than prior art log splitters since shorter lengths of material, lighter gauge material, and material having standard cross sections are used to construct the device. Furthermore, the dog leg shaped ram 30 facilitates the use of a double acting cylinder 20 and a double acting wedge 28 which alternately compresses logs placed on the table 17 between the first and second abutments 25 and 26. This increases the speed at which logs may be split on the log splitting device of the present invention by a factor of one half since the wedge 28 need not be reciprocated to an initial starting point adjacent one end of the log splitter.

In the preferred embodiment of the invention the first and second abutments 25 and 26 comprise generally rectangular sections of bar stock which extend between the first and second frame members 13 and 14 and are secured thereto for defining the transverse width W of the longitudinally extending channel 16. The first and second abutments 25 and 26 may be secured to the frame members 13 and 14 in any suitable manner such as by welding. Furthermore, in preferred embodiments, both the first and second abutments 25 and 26 are provided with a narrow log-engaging face 40 and a pair of side plates 41. The side plates 41 present surfaces sloping behind the log-engaging faces 40. In splitting logs, it is important that the split be entered only at one end as it is practically impossible to split at both ends along the same plane of fibers. While one end of the machine must avoid a splitting action, it must nevertheless eliminate any interference with the separation of the log so that power and force are not wasted. The nonsplitting supporting abutments 25 and 26 can resist splitting of the log by creating lateral friction, which resists separation of that end of the log, and by generating a reaction force against the outside edges of the log, which creates a moment that resists splitting of the log and tends to bind the ram and reciprocating wedge within the log. This latter binding effect is most troublesome since to combat this effect it is generally necessary to substantially increase the gauges of material from which the log splitting device is constructed in an effort to prevent deflection of the device and it is often necessary to substantially increase the size of the drive cylinder 20 and/or the pressure applied to the drive cylinder. More sturdy frames and drive cylinders of course increase the expense of the device. The present invention eliminates both of these tendencies by providing abutments 25 and 26 having rather narrow, vertically oriented log engaging faces 40 which localize pressure against the log on a central plane that closely parallels the splitting plane defined by the wedge 28. This feature improves the operational characteristics of the device by substantially eliminating the tendency of the device to bind and consequently allows the construction of the frame and ram of the device with lighter gauge materials.

The dog leg shaped ram 30 comprises the generally horizontally extending body portion 50, a first generally vertical portion 51 extending above the longitudinally extending channel 16 and a second generally vertical portion 52 extending below the channel 16. The body 50 and the first and second vertical portions 51 and 52 may be formed from bar stock and may be secured together by any suitable means such as by welding. The first generally vertical portion 51 includes the double acting wedge 28 which is a weldment that is built upon the first vertical portion 51. The second vertical portion 52 contains an aperture not illustrated herein for receiving through bolt 55 which pins the yoke 56 of connecting rod 31 of drive cylinder 20 to the second vertical portion 52.

To assemble the log splitting device of the present invention, the dog leg shaped ram 30 is dropped into the top of the longitudinally extending channel 16 and slid in the direction of the arrow 33 until the end 60 of the ram extends under the second abutment 26. Interference between the wedge 28 and the table 17 prevents removal of the opposite end 61 of the ram 30 from the bottom of the channel 16. One or more transversely extending plates, such as the plate 55, may be welded or otherwise suitably secured to the bottom of the first and second frame members 13 and 14 to prevent removal of the end 60 of the ram 30 from the bottom of the channel 16. The end 60 of the ram 30 extends under the second abutment 26 to prevent removal of the end 60 of the ram 30 upwardly from the channel 16. A second transversely extending plate such as the plate 62 is secured to the bottom portion of the ram 30 by a plurality of bolts 63 to prevent removal of the end 61 of the ram 30 upwardly from the channel 16. Thereafter the drive cylinder 20 is connected to the post 21 and the second vertical portion 52 of the ram 30 by through bolts 22 and 55. Preferably the transversely extending plate 62 is removably secured rather than being welded or otherwise fixedly secured to the ram 30 such that the ram 30 may be removed from the channel 16 for maintenance.

With specific reference now to FIG. 2, it is illustrated that in preferred embodiments the double acting wedge 28 comprises a multipiece weldment which is built onto the first generally vertical portion 51 of the dog leg shaped ram 30. More particularly, the sides of the wedge 28 are formed from first and second lengths of angle iron 71 and 72 which are welded to opposing sides of the generally vertical portion 51 of the ram 30. Cutting points are disposed on the front and rear of the wedge 28, the cutting points each comprising a first length of flat stock 74 having a sharpened edge 75. The first lengths of flat stock 74 are welded to the front and rear faces 78 and 79 of the first vertical portion 51 of the ram 30 with the edges 75 extending outwardly therefrom. Second and third lengths of flat stock 80 and 81 are welded to the first lengths of flat stock 74 and the side of the first generally vertical portion 51 of the ram 30 to define a pair of surfaces which slope behind opposing sides of the sharpened edges 75. Building the double acting wedge 28 from a weldment comprised of these lengths of stock of standard cross section, again reduces material costs.

Figure 4:
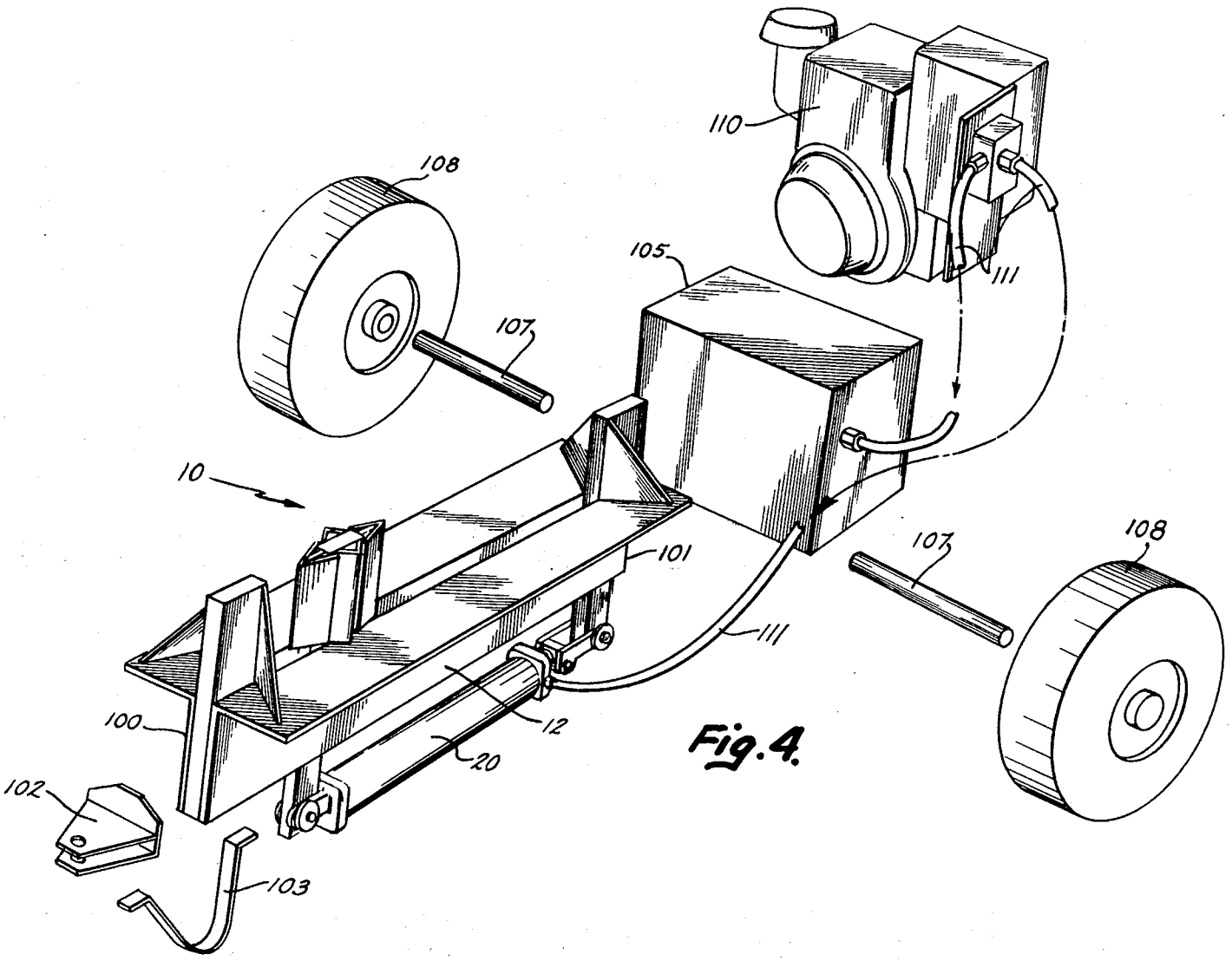
FIG. 4 is an exploded assembly of a self-contained log splitter employing the log splitting device of the present invention.

With reference now to FIG. 4, it is illustrated that the log splitting device 10 of the present invention may be adapted for use as a self-contained unit which is towable behind an automotive vehicle. In this case, the log splitting device 10 further comprises front and rear ends 100 and 101, respectively, disposed on the frame 12. A suitable tractor hitch 102 and skid 103 are welded or otherwise suitably secured to the front end 100 of the device. A hydraulic fluid reservoir 105 is welded or otherwise suitably secured to the rear end 101 of the frame 12 and an axle 107 is welded or otherwise suitably secured to the bottom of the reservoir 105. The axle 107 receives a pair of wheels 108 to facilitate towing of the log splitter. An internal combustion motor and hydraulic fluid pump 110 is disposed atop the fluid reservoir 105. Such motor pump combinations are commercially available and may be used for drawing hydraulic fluid from the reservoir 105 and delivering the same to the double acting drive cylinder 20 via pressure lines 111. Such commercially available motor and pump sets also normally include control valves for directing the flow of fluid to the drive cylinder 20 for reciprocating the same. The ram 30 of the log splitting device extends safely under the hydraulic fluid reservoir when the drive cylinder 20 is extended.

Figure 8:
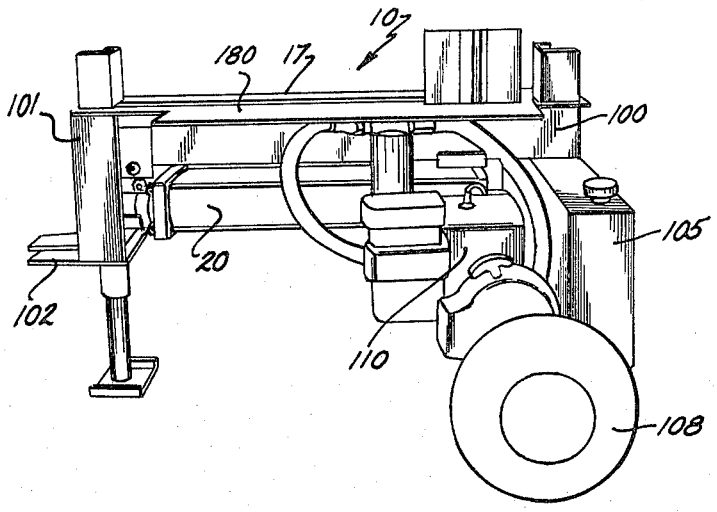
FIG. 8 is a perspective view of another embodiment of a self-contained log splitter employing the log splitting device of the present invention.
Figure 9:
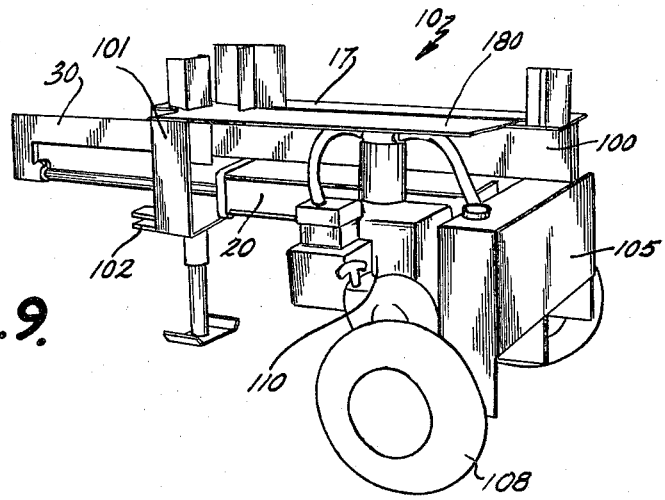
FIG. 9 is another perspective view of the log splitting device of FIG. 8.
Figure 10:
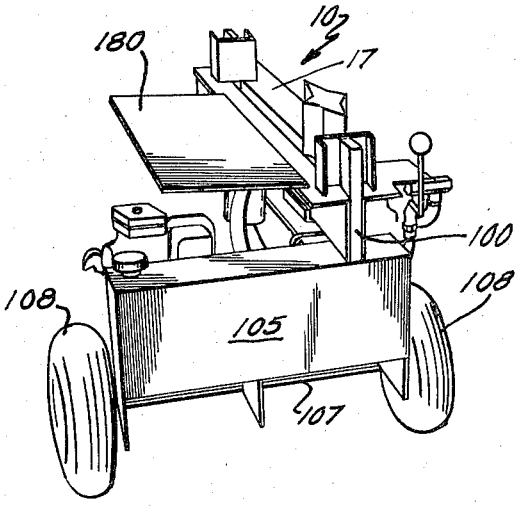
FIG. 10 is another perspective view of the log splitting device of FIGS. 8 and 9.

With reference now to FIGS. 8, 9 and 10 another embodiment of the log splitting device 10 of the present invention is illustrated. This embodiment of the invention is also self-contained and is adapted for towing behind an automotive vehicle. However, in this case the orientation of the log splitting device 10 is reversed. More specifically, the front and rear ends 100 and 101 are reversed such that the ram 30 no longer extends under the reservoir 105 when the drive cylinder 20 is extended but rather extends from the front end 101 of the log splitting device 10. A trailer hitch 102 is mounted on end 101 of the device to facilitate towing of the unit and the hydraulic tank 105 with the motor pump combination 110 disposed thereon is mounted on the end 100 of the device. In this embodiment of the device the hydraulic fluid reservoir 105 is disposed under the end 100 of the device rather than being welded to the end of the device in an abutting relationship. The motor pump combination 110 is connected to the side of the hydraulic reservoir 105 rather than being disposed thereatop. This allows the motor pump combination 110 to extend under the table 17 of the device and further shortens the log splitting device to provide an even more compact structure. An axle 107 and a pair of wheels 108 are again suitably secured to the underside of the reservoir 105 to facilitate towing of the unit. In this case, the table 17 includes a table extension 180 that may be formed from a sheet of plate steel welded or otherwise suitably secured to the table 17. The table extension 180 protects the motor pump combination 110 from logs and debris falling from the table 17 and provides a convenient resting place for the larger portion of a log when the operator is chipping or splitting off a plurality of smaller sections from the log.

Figure 5:
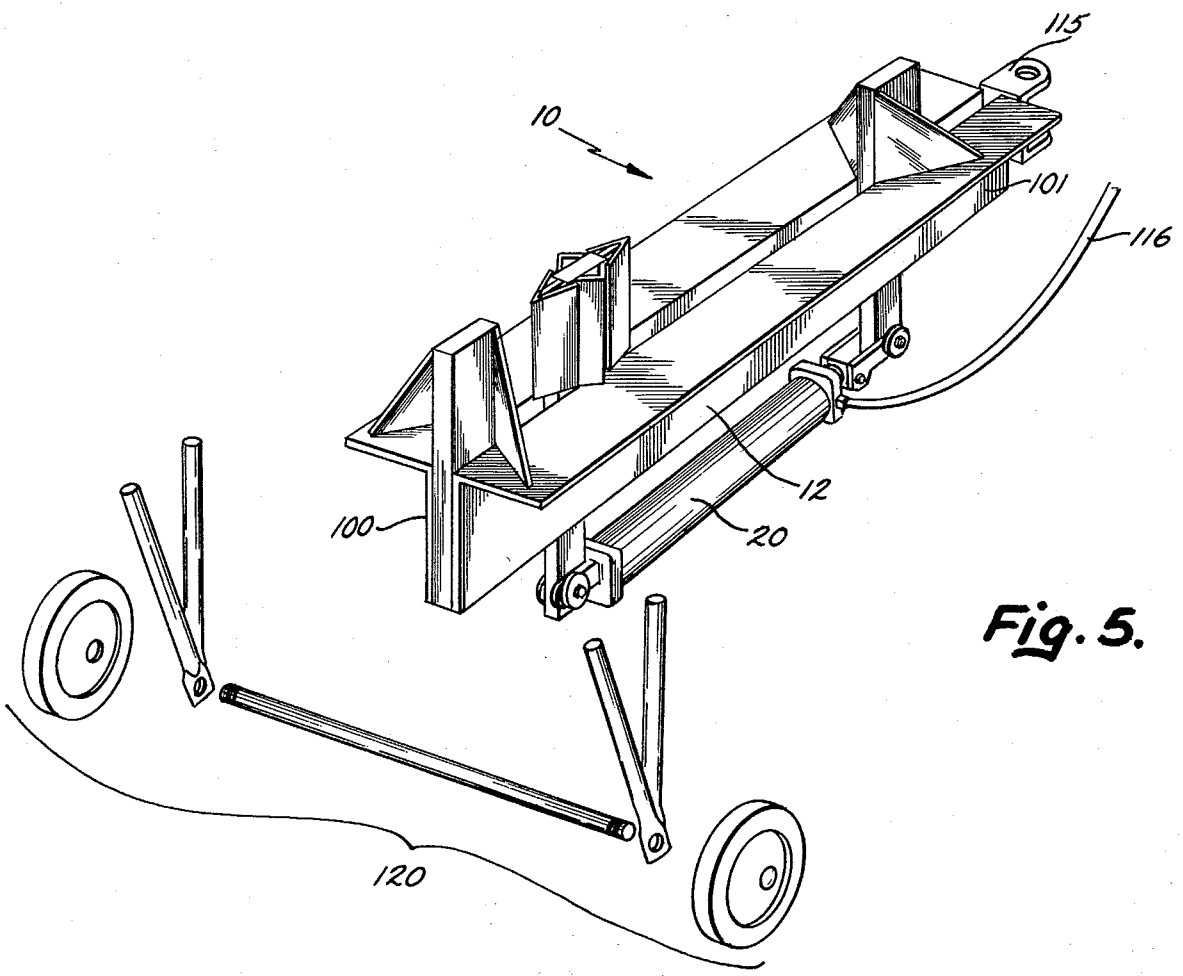
FIG. 5 is an exploded assembly of a log splitter adapted for use with a power take-off having an independent source of hydraulic pressure employing the log splitting device of the present invention.

With reference now to FIG. 5, it is illustrated that the log splitting device 10 of the present invention may be adapted for use with an independent source of hydraulic pressure such as that available from the power take-off of a garden or farm tractor. More specifically, in this case the rear end 101 of the frame 12 is lengthened to provide an area into which the ram 30 may safely extend when the drive cylinder 20 is extended and a suitable hitch 115 is provided for connecting the log splitter to the power take-off hitch of the tractor. Also, a suitable connecting hose 116 is provided for connecting the drive cylinder 20 to the hydraulic pressure outlet of the power take-off unit. A suitable axle and wheels 120 are welded or otherwise secured to the front end 100 of the frame 12 to support the end of the device opposing the tractor power take-off and for facilitating rolling of the device along with the tractor.

Figure 7:
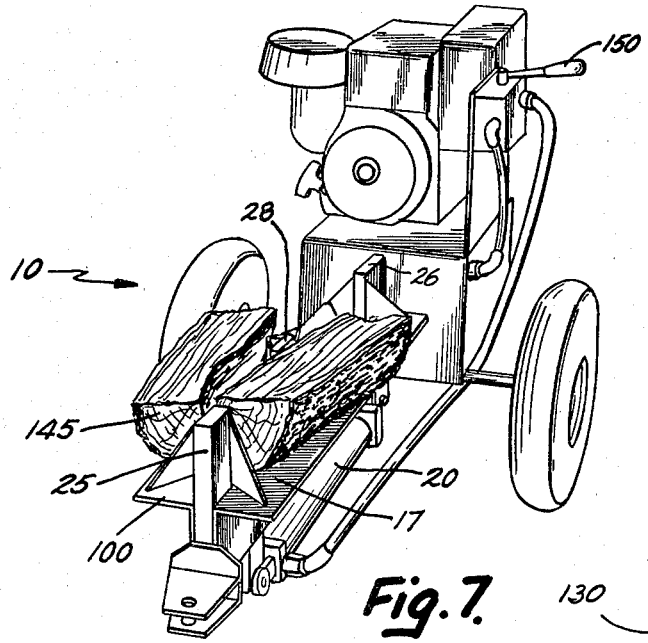
FIG. 7 is a perspective view of a log splitter constructed according to the present invention having a self-contained source of hydraulic pressure, the unit being adapted for towing behind an automotive vehicle.
Figure 6:
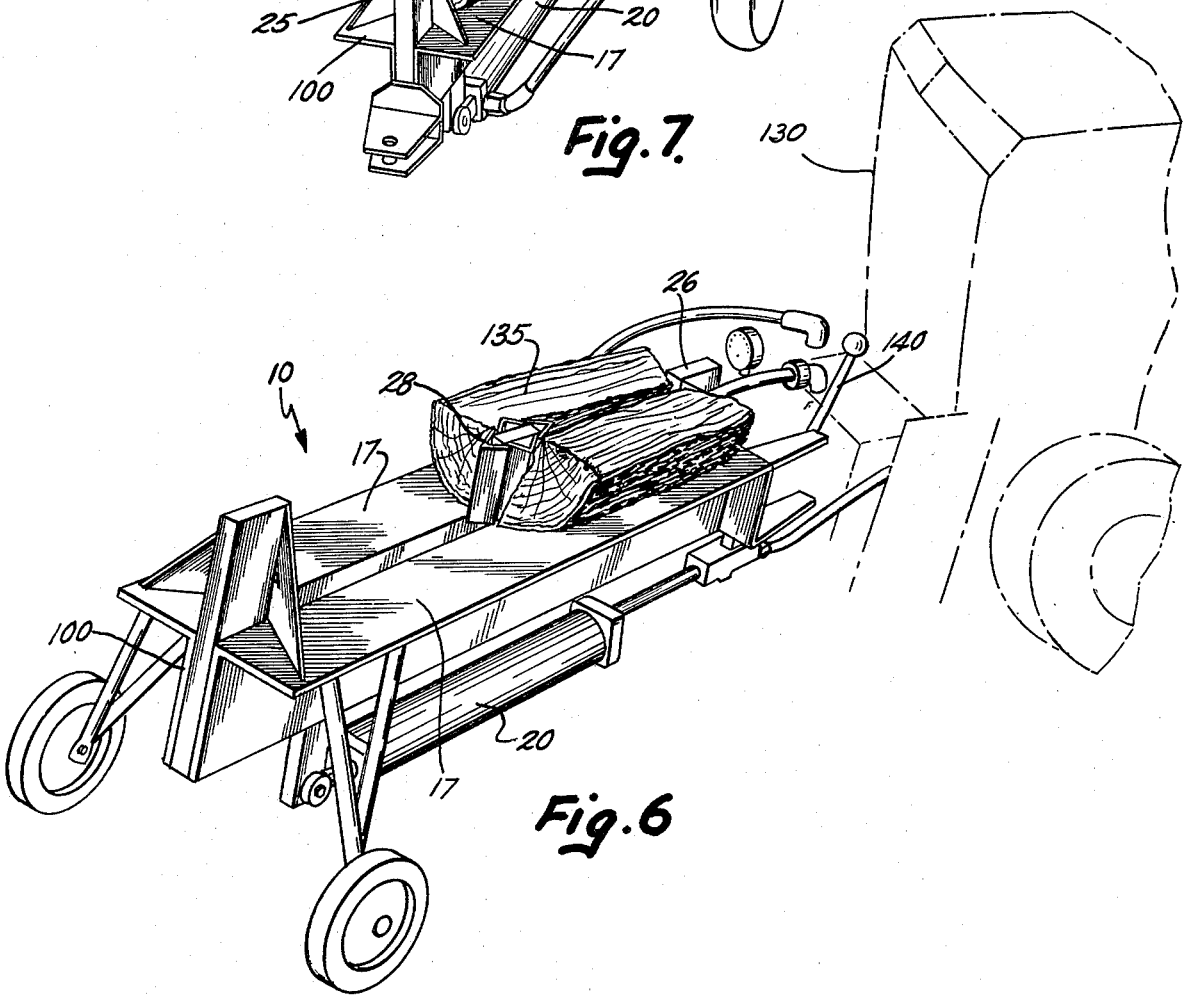
FIG. 6 is a perspective view of a log splitter constructed according to the present invention and adapted for use with the power take-off of a garden tractor.

With reference to FIGS. 6 and 7, the operation of the log splitting device 10 of the present invention will be illustrated in further detail. With reference to FIG. 6 showing an embodiment of the log splitter connected to the power takeoff of a garden tractor 130, the user simply places a log 135 atop the table 17 between the wedge 28 and the second abutment 26. Thereafter the control lever 140 of the power take-off unit disposed on the tractor 130 is actuated to deliver pressure to the drive cylinder 20 and compress the log 135 between the wedge 28 and the abutment 26. When sufficient force is applied by the drive cylinder 20, the wedge 28 will sink into the log 135 and split the same as illustrated in FIG. 6.

With reference now to FIG. 7 which, showing an embodiment of the log splitter 10 which is fully self-contained, it is illustrated that the device then may be loaded with a second log 145 disposed atop the table 17 between the wedge 28 and the first abutment 25. Thereafter, control lever 150 is used to direct hydraulic fluid to drive cylinder 20 to compress the log 145 between the wedge 28 and the abutment 25 and effectively split the same as illustrated in FIG. 7.

The above description should be considered as exemplary and that of the preferred embodiment only. The true spirit and scope of the present invention should be determined by reference to the appended claims. It is desired to include within the appended claims all modifications of the invention that come within the proper scope of the invention.

The embodiments of the invention in which an exclusive property or privilege is claimed are defined as follows:

1. A log splitting device comprising:

a frame;

a longitudinally extending channel defined by said frame;

a log receiving table defined by said frame;

said frame comprising first and second frame members having a generally L-shaped cross section, said first and second frame members being secured together to define said channel therebetween and said table thereatop;

a double-acting drive cylinder;

means for mounting said drive cylinder on said frame underneath said table;

first and second abutments disposed on opposing longitudinal ends of said channel;

a double-acting wedge mounted for longitudinal reciprocal movement between said abutments;

a dog leg shaped ram interconnecting said wedge and said drive cylinder, said dog leg shaped ram comprising a generally horizontal portion extending longitudinally in said channel, a first generally vertical portion, disposed on one end of said horizontal portion, said first vertical portion extending above said channel, and a second generally vertical portion, disposed on the opposite end of said horizontal portion, said second vertical portion extending below said channel;

said wedge being disposed on said first vertical portion of said dog leg shaped ram, said wedge including means for engaging said table for vertically locating one end of said dog leg shaped ram in said channel;

means for engaging the bottom of said first and second frame members disposed on said horizontal portion of said dog leg shaped ram for preventing withdrawal of said ram upwardly from said channel;

means for engaging said horizontal portion of said dog leg shaped ram, said means for engaging said ram being disposed at the bottom of said channel, proximate the opposite end of said horizontal portion of said dog leg shaped ram and between said first and second abutments, whereby said means for engaging said ram vertically locates the opposite end of said horizontal portion of said dog leg shaped ram;

said second vertical portion of said dog leg shaped ram being insertable between said means for engaging said ram and the abutment proximate said opposite end of said horizontal portion of said dog leg shaped ram, for the purpose of engaging said drive cylinder; and said opposite end of said horizontal portion of said dog leg shaped ram extending under the one of said first and second abutments disposed proximate said opposite end of said horizontal portion, whereby said dog leg shaped ram is trapped for reciprocal movement relative to said channel in a manner that minimizes the danger of binding.

2. The log splitting device of claim 1 wherein said first and second abutments extend between said first and second L-shaped frame members and said abutments are secured thereto, said abutments thereby defining the transverse width of said channel.

3. The log splitting device of claim 1 wherein each of said abutments is provided with a narrow log engaging face disposed in the splitting plane defined by said wedge and sides sloping behind said log engaging face to minimize binding.

4. The log splitting device of claim 2 wherein said means for engaging said horizontal portion of said dog leg shaped ram comprises at least one first transversely extending bottom plate secured to the bottom of said first and second L-shaped members to interconnect the same and retain the bottom of said ram within said channel.

5. The log splitting device of claim 4 wherein said means for engaging the bottom of said first and second frame members comprises at least one second transversely extending bottom plate secured to the bottom of said ram to prevent removal of said ram upwardly out of said channel.

6. The log splitting device of claim 1 wherein said wedge and said means for engaging said table comprises a multipiece weldment built on said first generally vertical portion of said dog leg shaped ram.

7. The log splitting device of claim 6 wherein said first generally vertical portion of said dog leg shaped ram is generally rectangular the sides of said wedge being formed from first and second lengths of angle iron welded to opposing sides of said generally vertical portion.

8. The log splitting device of claim 7 wherein cutting points are disposed on the front and rear of said wedge said cutting points each comprising a first length of flat stock having a sharpened edge, said first length of flat stock being welded to one of the front or rear sides of said first generally vertical portion of said dog leg shaped ram with said sharpened edge projecting outwardly therefrom; and second and third lengths of flat stock welded to said first length of stock and said first generally vertical portion of said dog leg shaped ram, said second and third lengths of flat stock defining a pair of surfaces sloping behind opposing sides of said sharpened edge.

9. The log splitting device of claim 1 wherein said log splitting device is a self-contained unit adapted for towing behind a vehicle, said log splitting device further comprising:

front and rear ends disposed on said frame, said front end being disposed adjacent one longitudinal end of said channel and said rear end being disposed adjacent the other longitudinal end of said channel;

a trailer hitch and a skid disposed on said front end of said frame;

a hydraulic fluid reservoir disposed on said rear end of said frame;

an axle and a pair of wheels disposed beneath said fluid reservoir; and an internal combustion motor and a hydraulic fluid pump driven by said motor disposed on said fluid reservoir for drawing fluid from said reservoir and applying the same to said drive cylinder under pressure.

10. The log splitting device of claim 1 wherein said log splitting device is adapted for use with an independent source of hydraulic pressure, said log splitting device further comprising:

front and rear ends disposed on said frame, said front end being disposed adjacent one longitudinal end of said channel and said rear end being disposed adjacent the other longitudinal end of said channel;

a hitch disposed on said rear end of said frame for connecting the same to a tractor power take-off; and an axle and wheels disposed beneath said front end of said frame.

* * * * *